US007279848B2

(12) United States Patent
Heckmann et al.

(10) Patent No.: US 7,279,848 B2
(45) Date of Patent: Oct. 9, 2007

(54) ELECTRONIC BALLAST FOR A LAMP

(75) Inventors: Markus Heckmann, Munich (DE); Thomas Pollischansky, Stadtbergen (DE)

(73) Assignee: Patent-Treuhand-Gesellschaft für Elektrische Glühlampen mbH, Munich (DE)

( * ) Notice: Subject to any disclaimer, the term of this patent is extended or adjusted under 35 U.S.C. 154(b) by 0 days.

(21) Appl. No.: 11/402,883

(22) Filed: Apr. 13, 2006

(65) Prior Publication Data

US 2006/0232224 A1 Oct. 19, 2006

(30) Foreign Application Priority Data

Apr. 15, 2005 (DE) ..... 10 2005 017 506

(51) Int. Cl.
*H05B 37/02* (2006.01)

(52) U.S. Cl. ..... 315/209 R; 315/219; 315/224

(58) Field of Classification Search ..... 315/224, 315/219, 209 R

See application file for complete search history.

(56) References Cited

U.S. PATENT DOCUMENTS 6,670,779 B2 * 12/2003 Shen ..... 315/291
6,710,552 B2 * 3/2004 Schmitt ..... 315/224

* cited by examiner

*Primary Examiner*—David H. Vu
(74) *Attorney, Agent, or Firm*—Carlo S. Bessone

(57) ABSTRACT

An electronic ballast for a lamp having a bridge circuit, includes at least one first switch and a second switch, a center point of the bridge circuit between the first and second switch, the center point coupled on one side to a reference potential via the series circuit including a first capacitor and a diode and on the other side to a first connection for the lamp via an inductance; a control unit for driving the first and second switches. The control unit has a supply connection coupled to the connection point between the first capacitor and the diode, the voltage across the supply connection being limited in terms of its amplitude, and having a measurement signal input for feeding a measurement signal to the control unit; the measurement signal input being coupled to the connection point between the first capacitor and the diode.

6 Claims, 3 Drawing Sheets

ELECTRONIC BALLAST FOR A LAMP

FIELD OF THE INVENTION

The present invention relates to an electronic ballast for a lamp having a bridge circuit, which comprises at least one first switch and a second switch, a center point of the bridge circuit being defined between the first switch and the second switch, said center point being coupled on one side to a reference potential via the series circuit comprising a first capacitor and a diode and on the other side to a first connection for the lamp via an inductance, a control unit for the purpose of driving the first switch and the second switch, the control unit having a supply connection which is coupled to the connection point between the first capacitor and the diode, the voltage across the supply connection being limited in terms of its amplitude, and having a measurement signal input for the purpose of feeding a measurement signal to the control unit.

BACKGROUND OF THE INVENTION

Such an electronic ballast which is known from the prior art is illustrated in FIG. 1. It comprises a control unit 10, which drives, in a known manner, a first switch S1 and a second switch S2 in a half-bridge arrangement. The switches S1, S2 are arranged between the so-called intermediate circuit voltage $U_{ZW}$ and the ground potential, a half-bridge center point M being formed between the switches S1, S2, across which half-bridge center point M the voltage $U_M$ drops. A supply circuit, which comprises a capacitor C1 and three diodes D1, D2 and D3, the diode D3 being in the form of a zener diode, is used for producing a supply voltage for the control unit 10 from the voltage $U_M$ at the half-bridge center point M. A lamp La is connected to the half-bridge center point M via an inductance L1, the first connection 12 for the lamp La being connected to the ground potential via a coupling capacitor C4, and a second connection 14 for the lamp La being connected to the ground potential via a coupling capacitor C5. Moreover, the control unit 10 has an input 16 which is used for identifying capacitive switching of the switches S1, S2. Capacitive switching indicates undesirable switching of the switches S1 and S2, in which, at the same time, both the voltage and current occur at the respective switch S1, S2. The respective switch S1, S2 is therefore not free of power loss during the switching operation, which on the one hand results in its life being shortened and on the other hand results in an increase in the total power loss of the electronic ballast. So-called soft switching is desired in which a switch is only switched on once the polarity-reversal operation has been concluded. For this purpose, the voltage $U_M$ at the half-bridge center point M is applied to the input 16 of the control unit 10 via a capacitive voltage divider, which comprises the capacitors C2 and C3.

This solution known from the prior art entails a plurality of disadvantages: firstly: since the capacitor C2 is connected directly to the half-bridge center point M and is thus subjected to the intermediate circuit voltage $U_{ZW}$, which is generally 450 V, at specific times, this capacitor needs to be implemented in the form of a high-quality and thus cost-intensive capacitor, for example of the so-called MKP type, owing to the required reliability—in the same manner as the so-called snubber C C1. These capacitors need to have, in particular, high dielectric strength. Secondly: the signal evaluated in the prior art, namely the voltage $U_M$ at the half-bridge center point M, increases comparatively slowly. This is due to the fact that the capacitor C1 is initially, i.e. at the beginning of a polarity-reversal operation, not charged. Since in this case the capacitors C2 and C3 need to be charged parallel in time to the capacitor C1, this results in a delay which leads to a slow rise in the voltage $U_M$ at the half-bridge center point M. Since the maximum amplitude of the measurement signal is intended to be concluded in the control unit 10 on the basis of the amplitude of the measurement signal at the time at which one of the switches S1, S2 is switched on, in this case it is necessary to wait for a very long period of time in order to obtain a sufficiently high amplitude value as the basis for the estimation. A low amplitude value would lead to an imprecise estimation. Thirdly: owing to the measurement signal evaluated in the control unit 10, unnecessary and therefore undesirable disconnection operations may result in the case of sensitively set control units 10.

SUMMARY OF THE INVENTION

The object of the present invention consists in developing a generic electronic ballast such that identification of capacitive switching of the two switches is thus made more cost-effective and insensitive and operation of the ballast can thus be implemented in a more reliable manner.

The present invention is based on the knowledge that the disadvantages associated with the prior art can be avoided if it is not the voltage $U_M$ at the half-bridge center point M which is evaluated for the purpose of identifying capacitive switching but the voltage between the capacitor and the diode which is connected to the reference potential on the opposite side to this capacitor. This measurement signal increases with the same gradient $dU_M/dt$ as the voltage $U_M$ at the half-bridge center point M. The maximum amplitude of the measurement signal is limited, however, for example by a zener diode. This means that the measurement signal reaches its maximum amplitude earlier than the voltage $U_M$ at the half-bridge center point. The measurement signal thus leads the voltage $U_M$ at the half-bridge center point M. Even very sensitively set control units 10 can thus be operated such that they do not lead to unnecessary disconnection operations. The control unit 10 is designed to check, at the end of the dead time of the bridge circuit, i.e. at the time at which none of the switches of the bridge circuit is switched on, whether the measurement signal has undergone polarity reversal, i.e. whether the measurement signal has reached the maximum of the other polarity to a fixed percentage. The control unit 10 thus makes it possible to respond to a slow or delayed polarity reversal of the measurement signal with the introduction of a disconnection or regulation operation.

In one preferred embodiment, the control unit 10 is implemented by the module Infineon ICB 1FL01G.

One preferred embodiment is characterized by the fact that a capacitive voltage divider having a second capacitor and a third capacitor is coupled to the connection point between the first capacitor and the diode, the measurement signal input being coupled to the connection point between the second capacitor and the third capacitor. Since the greater part of the voltage $U_M$ at the half-bridge center point M is used for charging the capacitor C1, a signal having a small signal amplitude is present at said point between the capacitor C1 and the diode. As a result, inexpensive capacitors having a low dielectric strength can be used for the capacitors of the capacitive voltage divider, for example SMD capacitors of the 0805 design or ceramic capacitors of the 1206 design. These are also characterized by having a smaller size than the capacitors which are required in the implementation in accordance with the prior art, with the result that the electronic ballast can have a very compact design.

One further advantageous embodiment is characterized by the fact that it also comprises a signal delay unit in order to delay the signal at the connection point between the first capacitor and the diode before it is fed to the measurement signal input. Since, as has already been mentioned above, the signal evaluated in this case leads the voltage $U_M$ at the half-bridge center point M, the measurement signal can be delayed for the purpose of adjusting the sensitivity of the response of the control unit 10.

In one particularly cost-effective implementation, a nonreactive resistor is connected as the delay unit between the connection point of the first capacitor and the diode and the second capacitor. The duration of the delay can be adjusted by means of the dimensions of this nonreactive resistor. Such a nonreactive resistor also has the advantage that parasitic HF oscillations in the measurement signal can thus be damped. This thus results in a further increase in the reliability of identification of capacitive switching.

The control unit preferably comprises a switching time determination unit in order to determine, from the measurement signal fed via the measurement signal input, whether the bridge circuit is operating capacitively.

The control unit is preferably also designed to deactivate the driving of the first and second switch when capacitive operation of the bridge circuit is established. This reliably prevents damage to the electronic ballast.

Further advantageous embodiments are described in the dependent claims.

BRIEF DESCRIPTION OF THE DRAWINGS

One exemplary embodiment of the invention will now be described in more detail below with reference to the attached drawings, in which.

DETAILED DESCRIPTION OF THE INVENTION

Figure 1:
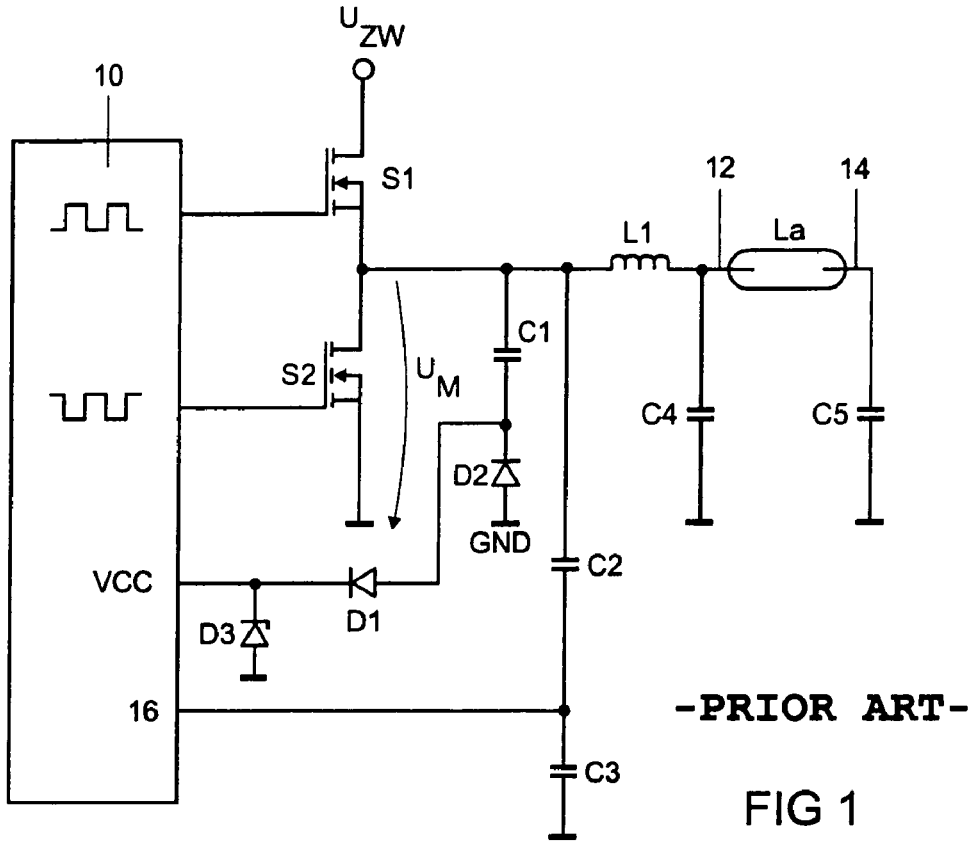
FIG. 1 shows a schematic illustration of a section of an electronic ballast known from the prior art for a lamp.
Figure 2:
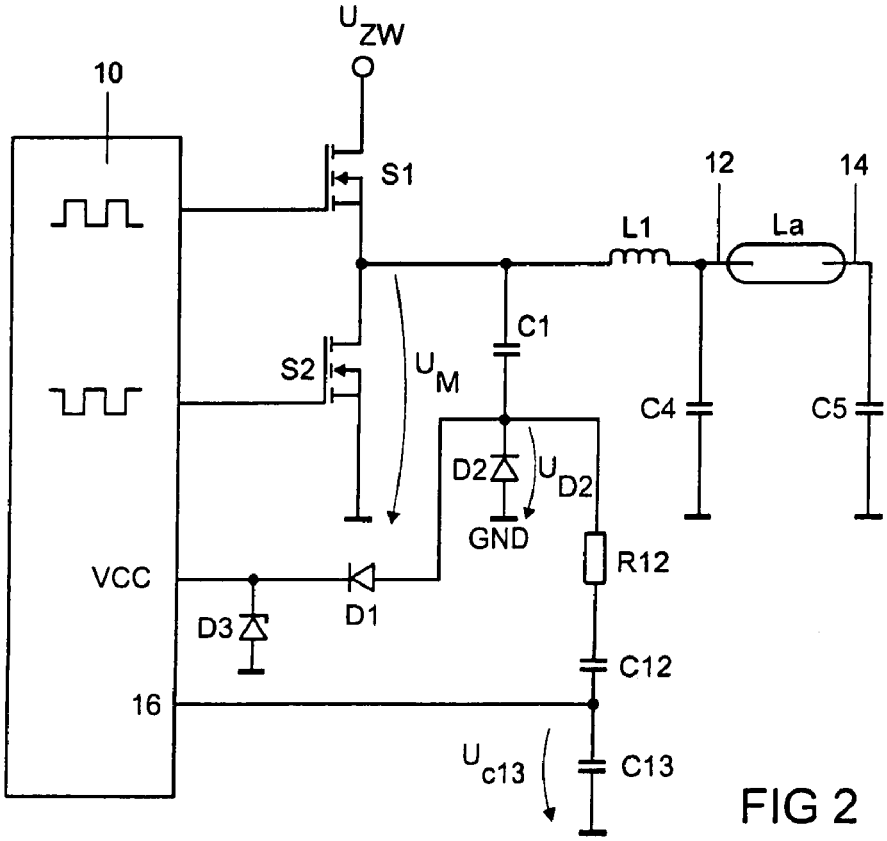
FIG. 2 shows a schematic illustration of a section of an electronic ballast according to the invention for a lamp.

FIG. 2 shows a schematic illustration of a section from an electronic ballast according to the invention, in which the components, which correspond to those in FIG. 1, are characterized by the same references and are not introduced again. This circuit is characterized by the fact that the voltage $U_{D2}$ at the connection point between the capacitor C1 and the diode D2 is used as the measurement signal for the purpose of identifying capacitive switching. In the exemplary embodiment illustrated, the diode D2 is connected to the ground potential. In this case, the voltage $U_{D2}$ is applied to a capacitive voltage divider, which comprises the capacitors C12 and C13, the voltage $U_{C13}$ across the capacitor C13 being applied to the input 16 of the control unit 10. The voltage $U_{D2}$ can also be applied, after conditioning, to the input 16 of the control unit 10 in another manner, for example using a resistive voltage divider. The resistor R12, which is connected between the connection point of the capacitor C1 and the diode D2 and the capacitor C12, is optional and is used for delaying the signal at the input 16 of the control unit 10.

Figure 3:
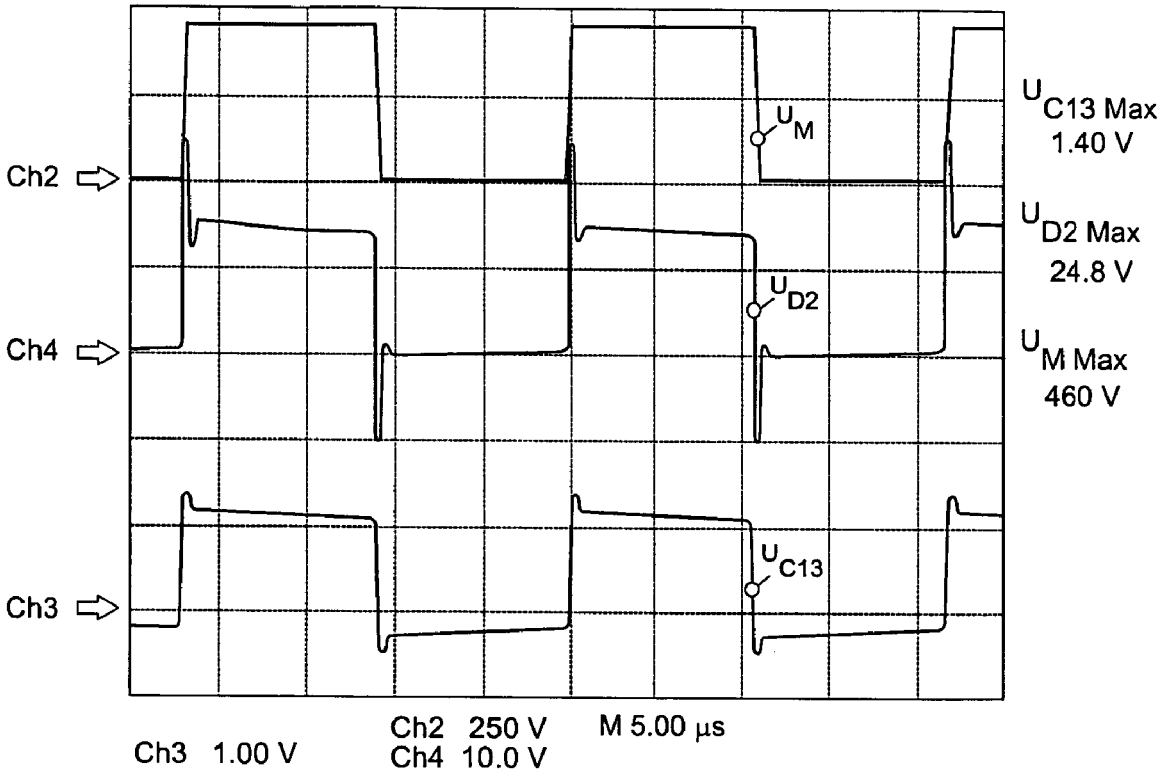
FIG. 3 shows the temporal profile of the voltages $U_M$, $U_{D2}$ and $U_{C13}$ with a resolution of 5 μs per unit.

FIG. 3 shows the temporal profile of the voltages $U_M$, $U_{D2}$ and $U_{C13}$, cf. FIG. 2, with a resolution of 5.00 μs per unit. As can be seen from the annotation in FIG. 3 at the right-hand edge, the maximum amplitude of the voltage $U_M$ is 460 V, that of the voltage $U_{D2}$ is 24.8 V and that of the voltage $U_{C13}$ is 1.44 V. As a result, in the case of capacitors C12 and C13 considerably less stringent demands can be placed on the dielectric strength than with the capacitors C2 and C3 in the electronic ballast known from the prior art.

Figure 4:
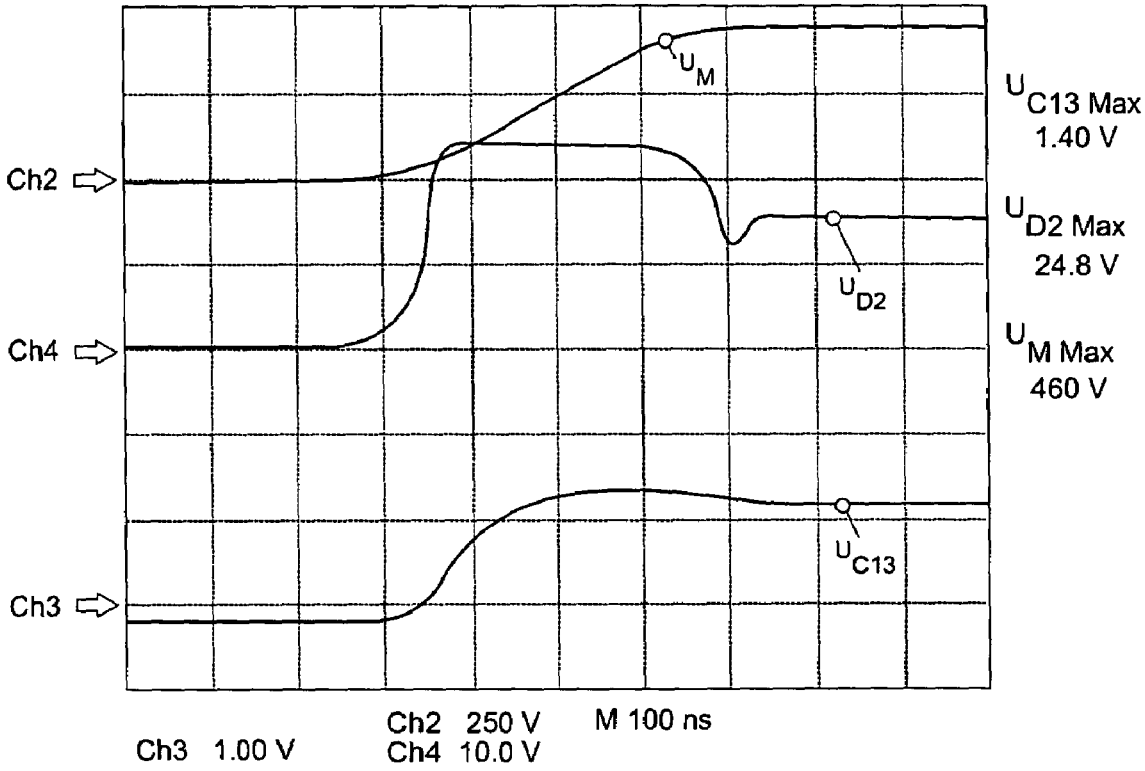
FIG. 4 shows the temporal profile of the voltages $U_M$, $U_{D2}$ and $U_{C13}$ with a resolution of 100 ns per unit.

FIG. 4 shows the temporal profile of the voltages $U_M$, $U_{D2}$ and $U_{C13}$ in an enlarged illustration with a resolution of 100 ns per unit, in this case the resistor R12 having been selected to have a value equal to 0 ohm. As can clearly be seen, the rise in the voltage $U_{D2}$ is much steeper than the rise in the voltage $U_M$. Owing to this greater edge gradient, it is possible to estimate the maximum value for this voltage and thus to give an indication of the capacitive switching much earlier and with a much greater degree of reliability than when evaluating the voltage $U_M$, as is carried out in the prior art. The voltage $U_{C13}$ is also characterized by having a much greater edge gradient compared to the voltage $U_M$. As a result, the maximum value is reached much earlier than with the voltage $U_M$. The resulting lead of the voltage $U_{C13}$ with respect to the voltage $U_M$ can be used for reducing the sensitivity of disconnection of the driving of the switches S1 and S2 by the control unit 10. As shown in FIG. 4, the measurement signal $U_{C13}$ leads the voltage $U_M$ by 106 ns.

By varying the value for the nonreactive resistor R12, the duration of a delay of the lead can be adjusted. Selecting R12 at 22 ohms delays the measurement signal $U_{C13}$ by 74 ns compared with FIG. 4, with the result that the lead is now 32 ns.

The invention claimed is:

1. An electronic ballast for a lamp, comprising:

a bridge circuit, which comprises at least one first switch (S1) and a second switch (S2), a center point (M) of the bridge circuit being defined between the first switch (S1) and the second switch (S2), said center point (M) being coupled on one side to a reference potential via the series circuit comprising a first capacitor (C1) and a diode (D2) and on the other side to a first connection (12) for the lamp (La) via an inductance (L1);

a control unit (10) for the purpose of driving the first switch (S1) and the second switch (S2), the control unit (10) having a supply connection (VCC) which is coupled to the connection point between the first capacitor (C1) and the diode (D2), the voltage across the supply connection (VCC) being limited in terms of its amplitude, and having a measurement signal input (16) for the purpose of feeding a measurement signal ($U_{C13}$) to the control unit (10); and characterized in that:

the measurement signal input (16) is coupled to the connection point between the first capacitor (C1) and the diode (D2); and the electronic ballast further comprises a signal delay unit (R12) in order to delay the signal ($U_{D2}$) at the connection point between the first capacitor (C1) and the diode (D2) before it is fed to the measurement signal input (16).

2. The electronic ballast as claimed in claim 1, characterized in that a nonreactive resistor (R12) is connected as the signal delay unit between the connection point of the first capacitor (C1) and the diode (D2) and the second capacitor (C12).

3. The electronic ballast as claimed in claim 1, characterized in that the voltage across the supply connection (VCC) of the control unit (10) is limited in terms of its amplitude by a zener diode (D3) or by means of a limiting device arranged in the control device (10).

4. An electronic ballast for a lamp, comprising:

a bridge circuit, which comprises at least one first switch (S1) and a second switch (S2), a center point (M) of the bridge circuit being defined between the first switch (S1) and the second switch (S2), said center point (M) being coupled on one side to a reference potential via the series circuit comprising a first capacitor (C1) and a diode (D2) and on the other side to a first connection (12) for the lamp (La) via an inductance (L1);

a control unit (10) for the purpose of driving the first switch (S1) and the second switch (S2), the control unit (10) having a supply connection (VCC) which is coupled to the connection point between the first capacitor (C1) and the diode (D2), the voltage across the supply connection (VCC) being limited in terms of its amplitude, and having a measurement signal input (16) for the purpose of feeding a measurement signal ($U_{C13}$) to the control unit (10); and characterized in that:

the measurement signal input (16) is coupled to the connection point between the first capacitor (C1) and the diode (D2); and the electronic ballast further comprises:

a capacitive voltage divider having a second capacitor (C12) and a third capacitor (C13) coupled to the connection point between the first capacitor (C1) and the diode (D2), the measurement signal input (16) being coupled to the connection point between the second capacitor (C12) and the third capacitor (C13); and a signal delay unit (R12) in order to delay the signal ($U_{D2}$) at the connection point between the first capacitor (C1) and the diode (D2) before it is fed to the measurement signal input (16).

5. The electronic ballast as claimed in claim 4, characterized in that a nonreactive resistor (R12) is connected as the signal delay unit between the connection point of the first capacitor (C1) and the diode (D2) and the second capacitor (C12).

6. The electronic ballast as claimed in claim 4, characterized in that the voltage across the supply connection (VCC) of the control unit (10) is limited in terms of its amplitude by a zener diode (D3) or by means of a limiting device arranged in the control device (10).

* * * * *